United States Patent [19]

Hirosawa et al.

[11] 4,005,690

[45] Feb. 1, 1977

[54] AUTOMATIC CHOKE VALVE APPARATUS IN AN INTERNAL COMBUSTION ENGINE

[75] Inventors: Yoshiaki Hirosawa, Tokyo; Toshio Nomura, Niiza; Masahiko Iiyama, Tokyo, all of Japan

[73] Assignee: Honda Giken Kogyo Kabushiki Kaisha, Tokyo, Japan

[22] Filed: June 23, 1975

[21] Appl. No.: 589,515

[52] U.S. Cl. ..... 123/119 F; 261/39 E; 261/64 R; 261/39 R

[51] Int. Cl.[2] ..... F02M 1/10; F02D 11/08; F02M 23/04

[58] Field of Search ..... 123/119 F, 179 G; 261/39 R, 39 B, 39 E, 64 R

[56] References Cited

UNITED STATES PATENTS

| | | | |
|---|---|---|---|
| 3,401,919 | 9/1968 | Seufert et al. | 123/119 F |
| 3,534,720 | 10/1970 | DuBois | 123/119 F |
| 3,818,881 | 6/1974 | Hosho et al. | 123/119 F |
| 3,906,911 | 9/1975 | Nakada et al. | 123/119 F |
| 3,948,240 | 4/1976 | Hirosawa et al. | 123/119 F |

*Primary Examiner*—Wendell E. Burns

[57] ABSTRACT

An automatic choke valve apparatus for an internal combustion engine in which an operation shaft connected to a choke valve provided in an intake passage of an internal combustion engine and a driving shaft connected to a pulse motor are connected together through an intermediate torsion spring and are engaged with one another through circumferentially disposed front and rear pawls for being feed-driven only in regular direction of rotation of the driving shaft. The choke valve is given a starting position setting in such manner that, by the operation of the pulse motor, the driving shaft undergoes excessive rotation beyond the fully closed position of the choke valve. A fast-idle cam cooperating with a throttle valve provided in the intake passage is angularly extended in one direction so as to form a low temperature cam portion comparatively large in cam height and the fast idle cam is connected to the driving shaft through a gang mechanism such as a link, so that in the course of excessive rotation of the driving shaft, the cam undergoes excessive rotation corresponding thereto and the low temperature cam portion is placed into operating position.

10 Claims, 5 Drawing Figures

AUTOMATIC CHOKE VALVE APPARATUS IN AN INTERNAL COMBUSTION ENGINE

CROSS-RELATED APPLICATION

This Application is related in subject matter to U.S. application Ser. No. 558,714 filed Mar. 14, 1975 now U.S. Pat. No. 3,948,240 and incorporates the content thereof hereinto by way of reference.

FIELD OF THE INVENTION

This invention relates to automatic choke valve apparatus in an internal combustion engine for a motorcar or the like and more particularly to a fast-idle cam apparatus thereof.

PRIOR ART

It is conventional in this type of apparatus for a fast-idle cam cooperating with a throttle valve to be connected to the choke valve so as to be movable therewith. In this arrangement, when the choke valve is rotated to its fully closed position the cam undergoes angular rotation corresponding thereto and thus it cannot be avoided that the open degree of the throttle valve for fast idle as produced by the cam is always constant. However, it is desirable that the open degree of the throttle valve be increased more at engine starting, especially at low temperatures as compared to engine starting at a normal temperature.

SUMMARY OF THE INVENTION

An object of this invention is to provide apparatus satisfying the requirement as enumerated above.

According to this invention, in an automatic choke valve apparatus for an internal combustion engine of the type in which an operation shaft connected to a choke valve provided in an intake passage of an internal combustion engine and a driving shaft connected to a pulse motor are connected together through an intermediate torsion spring and are additionally engaged with one another through circumferentially disposed front and rear pawls for being feed-driven only in regular direction of rotation of the driving shaft, such that the choke valve is given a starting position setting in the manner that, by the operation of the pulse motor, the driving shaft undergoes excessive rotation beyond the fully closed position of the choke valve (this being accomodated by the torsion spring which takes up the stress). A fast-idle cam is provided for cooperating with a throttle valve within the intake passage and the cam is extended in one direction to form a low temperature cam portion which is comparatively large in cam height, the fast idle cam being connected to the driving shaft through a mechanism such as a linkage, so that during excessive rotation of the driving shaft, the cam is subjected to an excessive rotation corresponding thereto and thereby the low temperature cam portion is selected to be in operative position.

DETAILED DESCRIPTION

Figure 1:
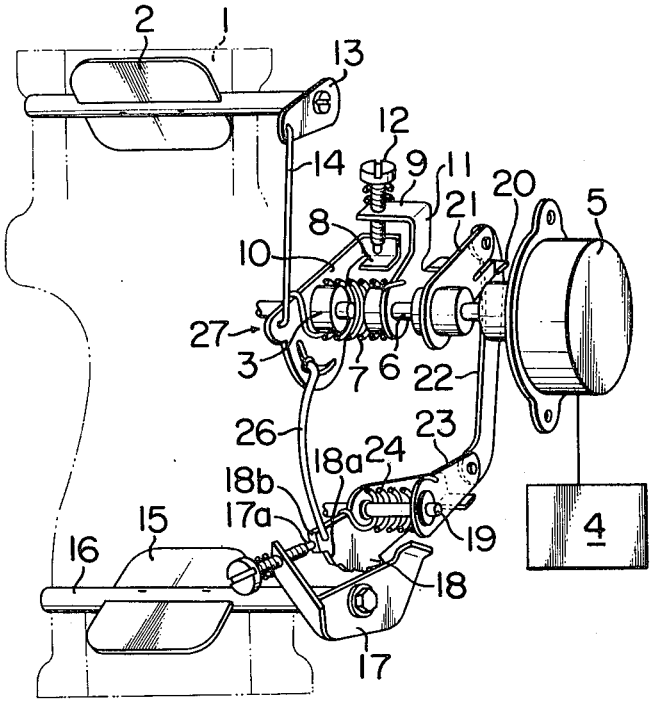
FIG. 1 is a perspective view of one embodiment according to this invention.

Referring to the drawings, numeral 1 denotes an intake passage of an internal combustion engine, numeral 2 denotes a choke valve mounted in passage 2 so as to be movable between open and closed positions and numeral 3 denotes an operation shaft connected to choke valve 2.

Mounted in one side of valve 3 is a pulse motor 5 connected to a driving pulse circuit 4. A driving shaft 6 is connected to the motor 5. The operation shaft 3 and the driving shaft 6 are connected together through an intermediate torsion spring 7 and they are engaged with one another through circumferentially disposed front and rear pawls 8,9 such that pawl 8 is feed-driven only in one direction of the driving shaft 6, that is, clockwise in the drawings. In the illustrated embodiment, the operation shaft 3 and the driving shaft 6 are provided with respective side arms 10,11 projecting therefrom and the respective ends thereof are formed as the aforesaid pawls 8,9. Pawls 9 is provided with an adjusting screw 12 for adjusting the engaging position between the two pawls. The choke valve 2 is provided at its outer end with a choke lever 13 and lever 13 is connected to the base end of the side arm 10 through a rod 14.

The driving pulse circuit 4 is not described in detail herein and it is constructed as disclosed in our copending application Ser. No. 558,714, filed Mar. 14, 1975, such that it is changed over in sequence from first to fourth operating conditions by respective detection of the closing of the ignition switch, closing of the starter switch, beginning of engine firing and continuing of the firing. The arrangement is such that in the first operating condition the pulse motor 5, and accordingly, the driving shaft 6 connected thereto is driven in reverse direction, that is, counterclockwise in the drawing, at a comparatively high speed; in the second operating condition the motor 5 and accordingly the driving shaft 6, is driven in regular direction, i.e., clockwise in the drawing at a comparatively high speed corresponding to engine temperature for a fixed time interval; in the third operating condition the motor 5 is driven in regular direction at a comparatively high speed for a fixed time interval and then in the fourth operating condition the motor 5 is driven in regular direction at a comparatively low speed corresponding to engine temperature. By these reverse and regular directions of rotation, the choke valve 2 is given the respective settings as shown in FIG. 5.

Figure 5:
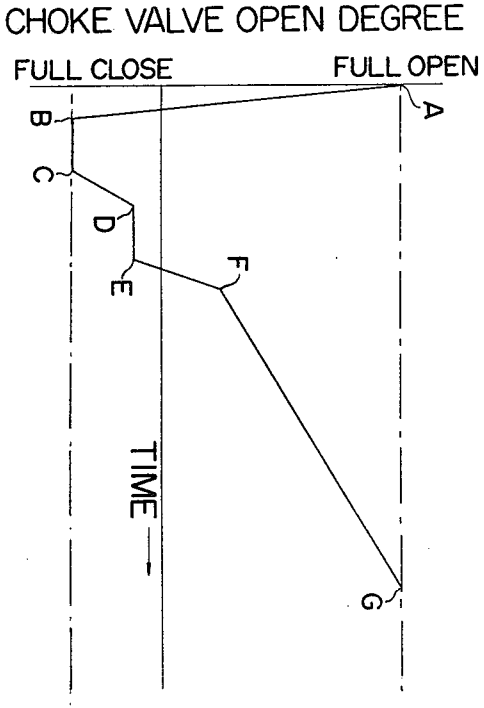
FIG. 5 is a graph showing the setting positions of a choke valve of the embodiment.

In greater detail, by the reverse direction of rotation of the driving shaft 6 in the first operating condition, the choke valve moves from point A in FIG. 5 to point B. Namely, the choke valve 2 is first rotated from its fully open position to its fully closed position, and further reverse rotation of the shaft 6 doesn't cause the choke valve 2 to be further rotated, but stresses the torsion spring 7 to generate a large resilient spring force. Thus the choke valve 2 is set into its fully closed position under a large resilient force by the spring 7 and thereby the valve 2 is given a standard position setting. When this condition is brought about, the output of the pulse motor 5 is balanced with the resilient force of the torsion spring 7 and no further twisting is produced in the spring 7, and thus the point B is moved to point C. By rotation of the driving shaft 6 in the regular direction of rotation in the second operating condition, the point C is moved to point D. Namely, by rotation in the regular direction of the driving shaft 6, the torsion spring 7 is untwisted slightly to decrease its resilient force, and thus the choke valve 2 remains in its fully closed position under the influence of a closing resilient force corresponding to engine temperature. This is the position for engine starting. Next, the regular direction rotation of the driving shaft 6 is stopped to continue this condition, whereby the point D is moved to a point E. In the next regular direction of rotation of the driving shaft 6 in the third condition, the point E is moved to point F. Namely, the choke valve 2 is not only released from the foregoing resilient load, but also given a feed-drive in the direction of its opening through the pawls 9,10 whereby it is in an open condition for engine firing. In the subsequent fourth operating condition, the point F is moved to point G. Namely, the choke valve 2 is gradually increased in its open degree at a speed corresponding to engine temperature. This is the operating position setting.

The above operation is substantially the same as disclosed in our aforesaid application Ser. No. 558,714.

Within the intake passage 1, there is conventionally mounted downstream of the choke valve 2, a throttle valve 15 with a shaft 16 movable between open and closed positions and a fast-idle cam 18 cooperates with the throttle valve through an operation lever 17, the cam 18 being rotatably mounted on a shaft 19. The cam 18 is slightly increased in its angular width in the clockwise direction in the drawing in comparision with the conventional cam of this kind and there is provided at this portion of increased width a low temperature cam portion **18*b* which is in continuation of a normal temperature cam portion 18*a* and slightly higher in cam height than portion 18*a*. The operation lever 17 has at its front end an engaging projection 17*a* which is in engagement with the cam 18**.

Instead of cam 18 being connected to the choke valve 2 as in the conventional construction, the cam 18 is coupled with driving shaft 6. Namely, a follower lever 21 is rotatably mounted on driving shaft 6 and is supported at its front surface by an arm 20 projecting laterally from the side arm 11 so that only by counterclockwise reverse direction of rotation of the driving shaft 6 can the follower lever 21 be pushed to turn counterclockwise in the drawing through the arm 20, and in the clockwise regular direction of rotation of the driving shaft 6 the lever 21 can follow the shaft 6 only by swinging clockwise under its own weight. The lever 21 is connected through a link 22 to a link 23 extending from the cam 18. The link 23 and the cam 18 are connected together so as to be escapable only in one direction against the action of a spring 24 interposed therebetween and thus the cam 18 is prepared for an unloader operation. An unloader mechanism is provided which is not substantially different from the conventional one. Namely, a pushing claw 25 is provided at the tip of the operation lever 17, so that by counterclockwise rotation of the pushing claw 25 in the drawing, the side arm 10 on the operation shaft 3 is rotated through the cam 18 facing the pushing claw 25 and a rod 26 connected to the cam 18. Thereby the choke valve 2 may be given an opening operation. There is provided at the front end portion of the rod 26 a lost motion mechanism 27 lest any undue force should be applied thereto.

Figure 2:
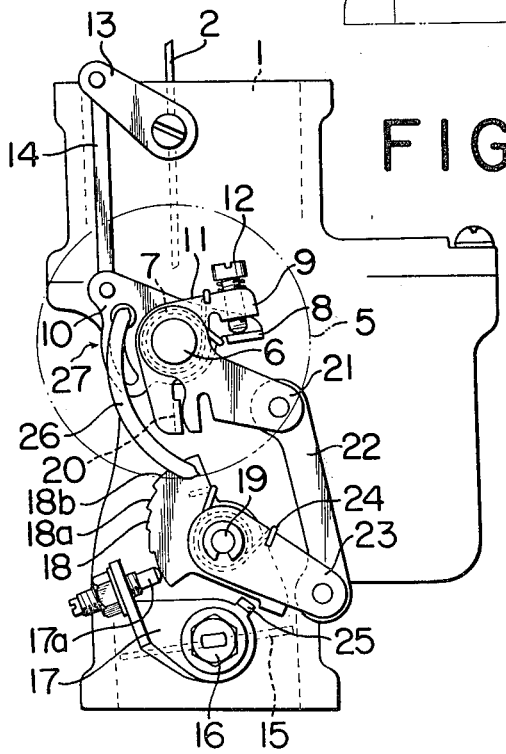
FIGS. 2–4 are side views thereof in respective operating conditions.
Figure 3:
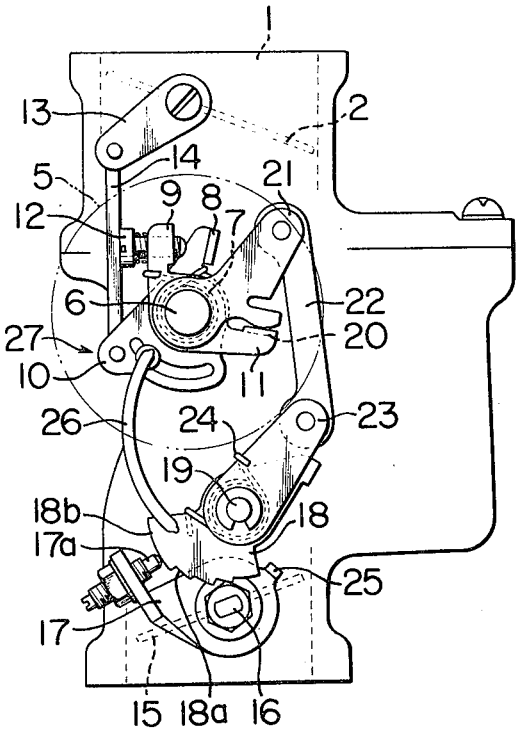
Figure 4:
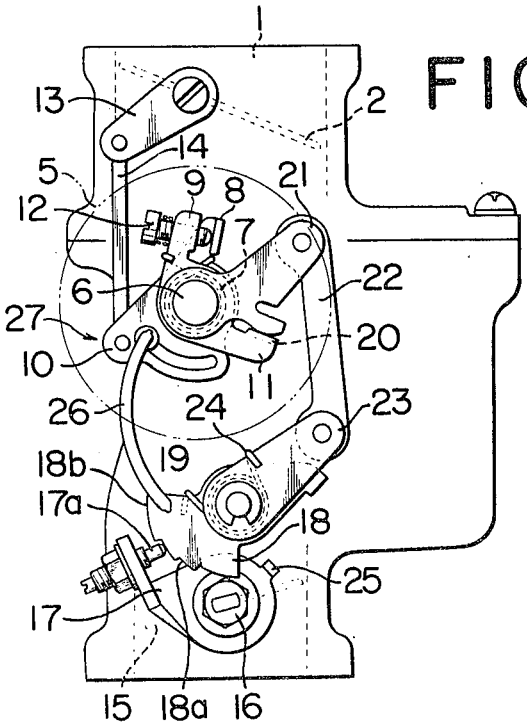

The operation of the apparatus will now be explained as follows:

The choke valve apparatus is changed from the condition shown in FIG. 2 to the said first operating condition in which the pulse motor 5 and accordingly the driving shaft 6, is rotated in the reverse direction and the point A in FIG. 5 is moved to the point B and as a result the choke valve 2 is given the standard position setting. The apparatus assumes the second operating condition when the driving shaft 6, is slightly rotated in the regular direction and the point B is moved from the point C to the point D, and thus the choke valve is in the position for engine starting. In this position, the driving shaft 6 has undergone excessive rotation and the pawls 8,9 are slightly separated from one another as shown in FIG. 3 and accordingly the fast-idle cam 18 is rotated counterclockwise in the drawing more than the conventional cam, through the arm 20, the follower lever 21 and the links 22,23. Thus the cam 18 is rotated so that the normal temperature cam portion **18*a* is not in operative position but rather the low temperature cam portion 18*b* is in operating position, and in accordance therewith the throttle valve 15 is given a fast-idle open degree by the low temperature cam portion 18*b* which is larger than that given by the normal temperature cam portion 18*a*. Thereby the engine is improved in its low temperature starting characteristic. In the case of starting at a normal temperature, the foregoing start position setting point E is higher than the position as shown in FIG. 5. In other words, in such a case the driving shaft 6 is reduced in its degree of excessive rotation or does not undergo excess rotation whereby the rotation angle of the fast-idle cam 18 is correspondingly smaller as shown in FIG. 4. Thus the valve 15 operates at the position corresponding to normal temperature cam portion 18*a*** and the degree of opening for fast-idle becomes comparatively small.

Thus, according to the invention, at low temperature engine starting, the choke valve starting position setting is utilized in which the driving shaft has rotated in excess beyond the fully closed position of the choke valve, so that the fast-idle cam is rotated in accordance therewith so that the low temperature cam portion at the extended end portion thereof is in the operating position and the degree of opening of the throttle valve for fast-idle is increased thereby. Consequently, engine starting at low temperature can be improved and the length of time for engine warm-up can be shortened.

What is claimed is:

1. Choke valve apparatus for an internal combustion engine comprising a rotatable choke valve, drive means for said choke valve including means for said choke valve including means for directly rotating the choke valve only in one direction of rotation of the drive means, and a spring rotatably coupling the drive means and said choke valve for rotation in the other direction, said choke valve being initially driven in reverse direction by said drive means in preparation for engine starting, to a fully closed position, the drive means undergoing continued excess rotation in reverse direction to place said spring under stress, a fast idle cam adapted for cooperating with a throttle valve for the engine and including an extended portion of relatively great height constituting a low temperature cam portion and means coupling said fast idle cam with said drive means so that the low temperature cam portion is in operative position when the drive means undergoes said excess rotation.

2. Choke valve apparatus as claimed in claim 1 wherein said drive means includes a drive shaft and a motor coupled to said drive shaft, said means for directly rotating the choke valve comprising front and rear side arms respectively connected with the choke valve and drive shaft and including circumferentially disposed front and rear pawls, said means coupling the fast idle cam with the drive means comprising linkage means coupling said drive shaft and said fast idle cam.

3. Choke valve apparatus as claimed in claim 2 wherein said linkage means includes a link member rotatably mounted on said drive shaft, a linkage assembly connecting the link member to the fast idle cam, and a support secured for rotation with said drive shaft and supporting said link member.

4. A choke valve apparatus as claimed in claim 3 wherein said support is securred to said rear side arm.

5. A choke valve apparatus as claimed in claim 4 wherein said support is integral with said rear side arm and is constituted by a laterally extending portion therein.

6. A choke valve apparatus as claimed in claim 2 wherein said linkage means includes a torsion spring.

7. A choke valve apparatus as claimed in claim 2 comprising unloader means coupling said fast idle cam and said front side arm for opening said choke valve when the throttle valve is opened.

8. A choke valve apparatus as claimed in claim 7 wherein said unloader means comprises a link member connecting said fast idle cam and said front side arm.

9. A choke valve apparatus as claimed in claim 8 comprising a lost motion connection between said link member and said front side arm.

10. A choke valve apparatus as claimed in claim 6 comprising unloader means coupling said fast idle cam and said front side arm for opening said choke valve when the throttle valve is opened.

* * * * *